US006799424B2

(12) United States Patent
Ioku et al.

(10) Patent No.: US 6,799,424 B2
(45) Date of Patent: Oct. 5, 2004

(54) HYDRAULIC CIRCUIT

(75) Inventors: Kensuke Ioku, Kobe (JP); Hitoshi Segawa, Kobe (JP)

(73) Assignee: Nabco, Ltd., Kobe (JP)

( * ) Notice: Subject to any disclaimer, the term of this patent is extended or adjusted under 35 U.S.C. 154(b) by 59 days.

(21) Appl. No.: 10/288,520

(22) Filed: Nov. 6, 2002

(65) Prior Publication Data

US 2003/0089106 A1 May 15, 2003

(30) Foreign Application Priority Data

Nov. 9, 2001 (JP) ..... 2001-343975

(51) Int. Cl.[7] ..... E02F 9/00

(52) U.S. Cl. ..... 60/328; 60/420; 60/484; 60/486; 340/463; 340/626

(58) Field of Search ..... 60/328, 420, 421, 60/422, 484, 486; 340/426, 463

(56) References Cited

U.S. PATENT DOCUMENTS 3,208,221 A * 9/1965 Schuetz ..... 91/6
3,922,855 A * 12/1975 Bridwell et al. ..... 60/421
4,367,624 A * 1/1983 Ogata et al. ..... 60/484
5,083,428 A * 1/1992 Kubomoto et al. ..... 60/421
6,657,541 B2 * 12/2003 Horikawa ..... 340/453

FOREIGN PATENT DOCUMENTS

JP 57-184136 11/1982
JP 4-118428 4/1992
JP 08080449 A * 3/1996 ..... B02C/21/02

* cited by examiner

*Primary Examiner*—Thomas E. Lazo
(74) *Attorney, Agent, or Firm*—Oblon, Spivak, McClelland, Maier & Neustadt, P.C.

(57) ABSTRACT

A hydraulic circuit comprises a first and a second merging line capable of supplying pressure oil from a third pump for a third circuit to directional control valves in a first and a second circuit, respectively, and a merging valve for selectively communicating or cutting off the first and the second merging line with or from the third pump. The merging valve has a first shift position at which the third pump is connected to the second merging line, and a second shift position at which the third pump is connected to the first and the second merging line. The merging valve is shifted continuously between the shift positions. The hydraulic circuit can efficiently distribute pressure oil supplied from the third pump to the first and/or second circuit as well, and can prevent lowering of the operability of each of actuators connected to the first or second circuit.

13 Claims, 5 Drawing Sheets

HYDRAULIC CIRCUIT

BACKGROUND OF THE INVENTION

1. Field of the Invention

The present invention relates to a hydraulic circuit for supplying pressure oil to a plurality of actuators, etc., and more particularly to a hydraulic circuit for use in construction machines such as a crawler vehicle provided with a plurality of actuators, including a hydraulic excavator.

2. Description of the Related Art

Known hydraulic circuits for use in construction machines such as a crawler vehicle are disclosed in, e.g., Japanese Unexamined Patent Application Publication Nos. 4-118428 and 57-184136. Those disclosed hydraulic circuits are used in construction machines provided with a pair of right and left hydraulic travel actuators (crawler travel devices) and hydraulic work actuators (such as a bucket, a boom, an arm, and a swivel), and include directional control (selecting) valves for controlling a direction of connection between a hydraulic pump or tank and each actuator and a flow rate of pressure oil therebetween in order to operate the actuator.

In each of the hydraulic circuits disclosed in Japanese Unexamined Patent Application Publication Nos. 4-118428 and 57-184136, pressure oil is supplied from three first to third hydraulic pumps, and each of these hydraulic pumps is connected to three hydraulic circuits including respectively directional control valves for the right and left hydraulic travel actuators (hereinafter referred to as "right and left travel directional control valves") and a directional control valve for the swivel actuator (hereinafter referred to as a "swivel directional control valve"). More specifically, the first and second hydraulic pumps are connected to hydraulic circuits (hereinafter referred to as "first and second circuits") each including the right or left travel directional control valve and the directional control valves for the other work actuators (hereinafter referred to as "other work directional control valves"), while the third hydraulic pump is connected to a hydraulic circuit (hereinafter referred to as a "third circuit") including the swivel directional control valve, etc. Such an arrangement ensures independency of the swivel operation from the operation of the other actuators.

Then, any of those hydraulic circuits includes a selector valve (combined operation control valve, hereinafter referred to as a "merging valve") for changing over the third pump, which is connected to the third circuit, to be connectable with the first or second circuit as well. Upon shift of the merging valve, the pressure oil from the third pump can also be supplied to the first or second circuit so that when the travel actuator and the other work actuator(s) both connected to the first or second circuit are operated at the same time, the pressure oil is supplied at a sufficient flow rate to the other work actuator(s).

In the hydraulic circuit disclosed in the above-cited Japanese Unexamined Patent Application Publication No. 4-118428, the merging valve is connected to a hydraulic line led out of the side upstream of the swivel directional control valve (swivel control valve), thus enabling the pressure oil to be supplied to the first or second circuit through the associated hydraulic lines. With such an arrangement, the pressure oil from the third pump can be supplied to the other work actuators in the first or second circuit upon the shift of the merging valve. In the merging mode, however, there is a fear that the pressure oil is supplied at a larger flow rate to one of the other work actuators in the first and second circuits, which is subjected to a lower load, and the pressure oil supplied to the swivel directional control valve, etc. in the third circuit (including a directional control valve connected to a blade cylinder in the above-cited Japanese Unexamined Patent Application Publication No. 4-118428) is reduced. This may deteriorate the operability of the actuators connected to those directional control valves.

Also, in the hydraulic circuit disclosed in the above-cited Japanese Unexamined Patent Application Publication No. 57-184136, the merging valve is connected to the third circuit downstream of the swivel directional control valve, thus enabling the pressure oil to be supplied to the other work actuators in the first or second circuit (first directional control valve group in the above-cited Japanese Unexamined Patent Application Publication No. 57-184136). With such an arrangement, when the swivel directional control valve in the third circuit is shifted to such an extent that an unloading line is closed, the pressure oil is no longer supplied to the merging valve. In such a case, therefore, the pressure oil from the third pump cannot be supplied to the other work actuators in the first or second circuit.

SUMMARY OF THE INVENTION

In view of the state of the art mentioned above, it is an object of the present invention to provide a hydraulic circuit, which can efficiently distribute pressure oil supplied from a third pump connected to a third circuit to a first and/or second circuit as well, and can improve the operability of actuators.

To achieve the above object, the present invention provides a hydraulic circuit for driving actuators by pressure oil supplied from a first pump, a second pump and a third pump and returned to a tank, the hydraulic circuit comprising a first circuit including a directional control valve supplied with the pressure oil from the first pump, the directional control valve in the first circuit controlling connection between the first pump or the tank and at least one of the actuators and a flow rate of the pressure oil therebetween; a second circuit including a directional control valve supplied with the pressure oil from the second pump, the directional control valve in the second circuit controlling connection between the second pump or the tank and at least one of the actuators and a flow rate of the pressure oil therebetween; a third circuit including a directional control valve supplied with the pressure oil from the third pump, the directional control valve in the third circuit controlling connection between the third pump or the tank and at least one of the actuators and a flow rate of the pressure oil therebetween; a first merging line disposed to be capable of supplying the pressure oil sent from the third pump under a pressurized state to the directional control valve in the first circuit; a second merging line disposed to be capable of supplying the pressure oil sent from the third pump under a pressurized state to the directional control valve in the second circuit; and a merging valve for selectively communicating or cutting off the first merging line and the second merging line with or from the third pump, the merging valve having a first shift position at which the third pump is connected to the second merging line, and a second shift position at which the third pump is connected to the first merging line and the second merging line, the merging valve being continuously shifted between the first shift position and the second shift position depending on a state of the first circuit or the second circuit.

In the hydraulic circuit constructed as set forth above, preferably, when the directional control valve in the first circuit is not operated, the merging valve is shifted to the first shift position, and when the directional control valve in the first circuit is operated, the merging valve is shifted toward the second shift position depending on a state of operation of the directional control valve in the first circuit.

Alternatively, in the hydraulic circuit constructed as set forth above, the merging valve may be continuously shifted between the first shift position and the second shift position depending on a flow rate of the pressure oil required by the directional control valve in the first circuit or the second circuit so that the pressure oil from the third pump is distributed and sent to the first circuit or the second circuit under a pressurized state.

With the above features, when the directional control valve in the first circuit is not operated, the merging valve is shifted to the first shift position, whereupon a part of the pressure oil sent to the third circuit under the pressurized state can be supplied to the second circuit, which requires supply of the pressure oil, without wasteful loss while preventing that part of the pressure oil from being supplied to the first circuit in which the directional control valve is not operated. Also, when the directional control valve in the first circuit is operated, the merging valve is shifted to the second shift position so that surplus pressure oil sent from the third pump under the pressurized state can be supplied to not only the second circuit but also the first circuit. Further, when the flow rate of the pressure oil supplied to the actuator with the operation of the directional control valve in the first circuit (i.e., the flow rate of the pressure oil required by that directional control valve) is small, the pressure oil is sent from the third pump to the second circuit at a larger flow rate. As the flow rate of the pressure oil required by the directional control valve in the first circuit increases, the merging valve is shifted toward the second shift position proportionally, thereby increasing the flow rate of the pressure oil supplied from the third pump to the first circuit and decreasing the flow rate of the pressure oil supplied from the third pump to the second circuit. Thus, the pressure oil supplied from the third pump connected to the third circuit can be efficiently distributed to the first and/or second circuit.

The present invention also provides a hydraulic circuit for driving actuators by pressure oil supplied from one pump and the other pump and returned to a tank, the hydraulic circuit comprising one circuit including a directional control valve supplied with the pressure oil from the one pump, the directional control valve in the one circuit controlling connection between the one pump or the tank and at least one of the actuators and a flow rate of the pressure oil therebetween; the other circuit including a directional control valve supplied with the pressure oil from the other pump, the directional control valve in the other circuit controlling connection between the other pump or the tank and at least one of the actuators and a flow rate of the pressure oil therebetween; a merging line disposed to be capable of supplying the pressure oil sent from the other pump under a pressurized state to the directional control valve in the one circuit; and a merging valve for selectively communicating or cutting off the merging line with or from the other pump, the merging valve being capable of sending the pressure oil from the other pump under a pressurized state to the one circuit and reducing an opening degree of a throttle disposed between the other pump and the tank depending on a flow rate of the pressure oil required by the directional control valve in the one circuit, thereby increasing a flow rate of the pressure oil sent to the one circuit under the pressurized state.

In the hydraulic circuit constructed as set forth above, the one circuit may comprise two first and second hydraulic circuits each including a directional control valve.

With the above features, since the pressure oil not required by the directional control valve in the one circuit is returned to the tank, the pressure oil from the other pump can be efficiently supplied to the one circuit under the pressurized state without imposing overload on the other pump.

Further, the present invention provides a hydraulic circuit for driving actuators by pressure oil supplied from one pump and the other pump and returned to a tank, the hydraulic circuit comprising one circuit including a directional control valve supplied with the pressure oil from the one pump, the directional control valve in the one circuit controlling connection between the one pump or the tank and at least one of the actuators and a flow rate of the pressure oil therebetween; the other circuit including a directional control valve supplied with the pressure oil from the other pump, the directional control valve in the other circuit controlling connection between the other pump or the tank and at least one of the actuators and a flow rate of the pressure oil therebetween; a merging line disposed to be capable of supplying the pressure oil sent from the other pump under a pressurized state to the directional control valve in the one circuit; and a merging valve for selectively communicating or cutting off the merging line with or from the other pump, the merging valve having a shift position at which the side upstream of the directional control valve in the other circuit is connected to the one circuit through a throttle and the side downstream of the directional control valve in the other circuit is also connected to the one circuit.

In the hydraulic circuit constructed as set forth above, the one circuit may comprise two first and second hydraulic circuits each including a directional control valve.

With the above features, the pressure oil sent from the other pump under the pressurized state can be supplied to the one circuit while supplying the pressure oil from the other pump to the other circuit. In addition, surplus pressure oil drained from the side downstream of the directional control valve in the other circuit can also be supplied to the one circuit under the pressurized state. Accordingly, the pressure oil from the other pump connected to the other circuit can be efficiently distributed to the one circuit, and the operability of the actuator connected to the one circuit can be improved.

Still further, the present invention provides a hydraulic circuit for driving actuators by pressure oil supplied from a first pump, a second pump and a third pump and returned to a tank, the hydraulic circuit comprising a first circuit including a directional control valve supplied with the pressure oil from the first pump, the directional control valve in the first circuit controlling connection between the first pump or the tank and at least one of the actuators and a flow rate of the pressure oil therebetween; a second circuit including a directional control valve supplied with the pressure oil from the second pump, the directional control valve in the second circuit controlling connection between the second pump or the tank and at least one of the actuators and a flow rate of the pressure oil therebetween; a third circuit including a directional control valve supplied with the pressure oil from the third pump, the directional control valve in the third circuit controlling connection between the third pump or the tank and at least one of the actuators and a flow rate of the pressure oil therebetween; a first merging line disposed to be capable of supplying the pressure oil sent from the third pump under a pressurized state to the directional control valve in the first circuit; a second merging line disposed to be capable of supplying the pressure oil sent from the third pump under a pressurized state to the directional control valve in the second circuit; and a merging valve for selectively communicating or cutting off the first merging line and the second merging line with or from the third pump, the merging valve having a shift position at which the third pump is connected to the first merging line and the second merging line, the shift position establishing a state that the side upstream of the directional control valve in the third circuit is connected to the first circuit through a first throttle, the side upstream of the directional control valve in the third circuit is connected to the second circuit through a second throttle, and the side downstream of the directional control valve in the third circuit is connected to the first circuit.

With the above features, the pressure oil sent from the third pump under the pressurized state can be supplied to the first and second circuits while supplying the pressure oil from the third pump to the third circuit. In addition, surplus pressure oil drained from the side downstream of the directional control valve in the third circuit can also be supplied to the first circuit under the pressurized state. Accordingly, the pressure oil from the third pump connected to the third circuit can be efficiently distributed to the first circuit and the second circuit, and the operability of the actuators connected to the first and second circuits can be improved without reducing the operability of the actuator connected to the third circuit.

The hydraulic circuit constructed as set forth above may further comprise sub-valves operating in interlock with the directional control valves in the first circuit and the second circuit, the sub-valves generating a pilot pressure for shifting the merging valve to the aforesaid shift position. Also, the hydraulic circuit may further comprise detecting means disposed in a line for the pilot pressure, the detecting means detecting a state of operation of the corresponding actuator.

With the above features, the state of operation of the actuators can be detected by utilizing the sub-valves and the pilot hydraulic system for shifting the merging valve. Accordingly, it is possible to obviate the need of adding a special circuit only dedicated for detecting the state of operation of the actuators, and to prevent an increase in size of devices such as the directional control valves.

Still further, the present invention provides a hydraulic circuit for use in a traveling construction machine including actuators driven by pressure oil supplied from a hydraulic pump under a pressurized state and returned to a tank, and provided with a safety device for informing surroundings of the fact the construction machine is traveling, the hydraulic circuit comprising a travel control valve for controlling connection between the hydraulic pump or the tank and a travel actuator of the actuators and a flow rate of the pressure oil therebetween; and a travel signal hydraulic line for generating a travel signal upon operation of the travel control valve, the safety device being operated in accordance with a state of the travel signal hydraulic line.

Still further, the present invention provides a hydraulic circuit for use in a construction machine having an auto-idle function of controlling a rotational speed of a driving source for a hydraulic pump depending on a state of operation of each of actuators driven by pressure oil supplied from the hydraulic pump under a pressurized state and returned to a tank, the hydraulic circuit comprising a travel control valve for controlling connection between the hydraulic pump or the tank and a travel actuator of the actuators and a flow rate of the pressure oil therebetween; another control valve for controlling connection between the hydraulic pump or the tank and other one of the actuators than the travel actuator and a flow rate of the pressure oil therebetween; a travel signal hydraulic line for generating a travel signal upon operation of the travel control valve; and an auto-idle signal hydraulic line for generating an auto-idle signal upon operation of the other control valve, the rotational speed of the driving source being controlled in accordance with a state of the travel signal hydraulic line and a state of the auto-idle signal hydraulic line.

With the above features, since the hydraulic line for detecting the state of operation is divided into one for the travel directional control valve and the other directional control valve, the hydraulic circuit can include in more efficient arrangement not only a system for detecting the operations of both the travel directional control valve and the other directional control valve as required for detecting the auto-idle signal, but also a system for detecting the operation of only the travel directional control valve as required for operating a safety device. It is hence possible to obviate the need of adding a special circuit only dedicated for detecting the state of the travel operation, and to prevent an increase in size of devices such as the directional control valves.

DESCRIPTION OF THE PREFERRED EMBODIMENTS

Figure 1:
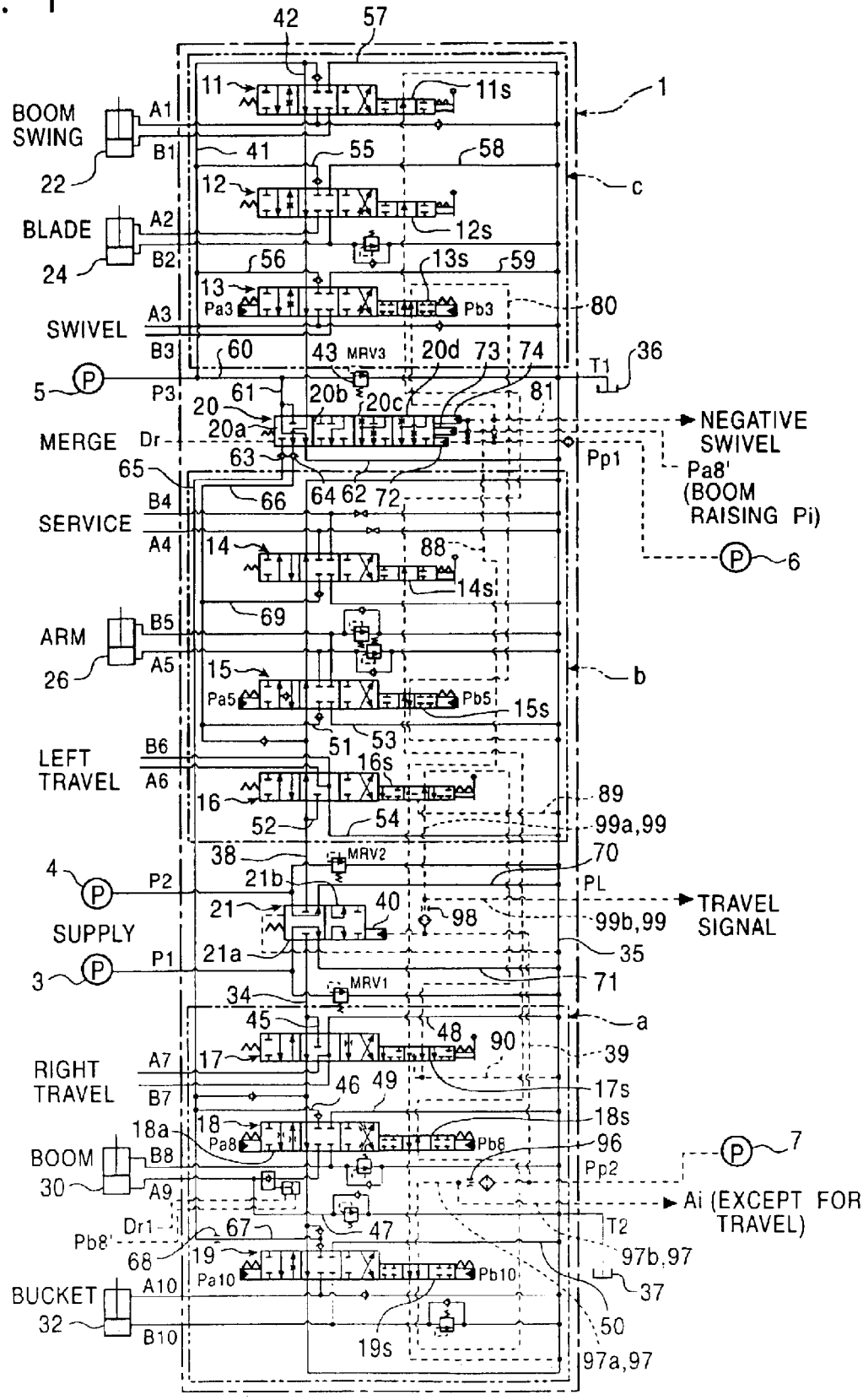
FIG. 1 is a circuit diagram of a hydraulic circuit according to an embodiment of the present invention.
Figure 3:
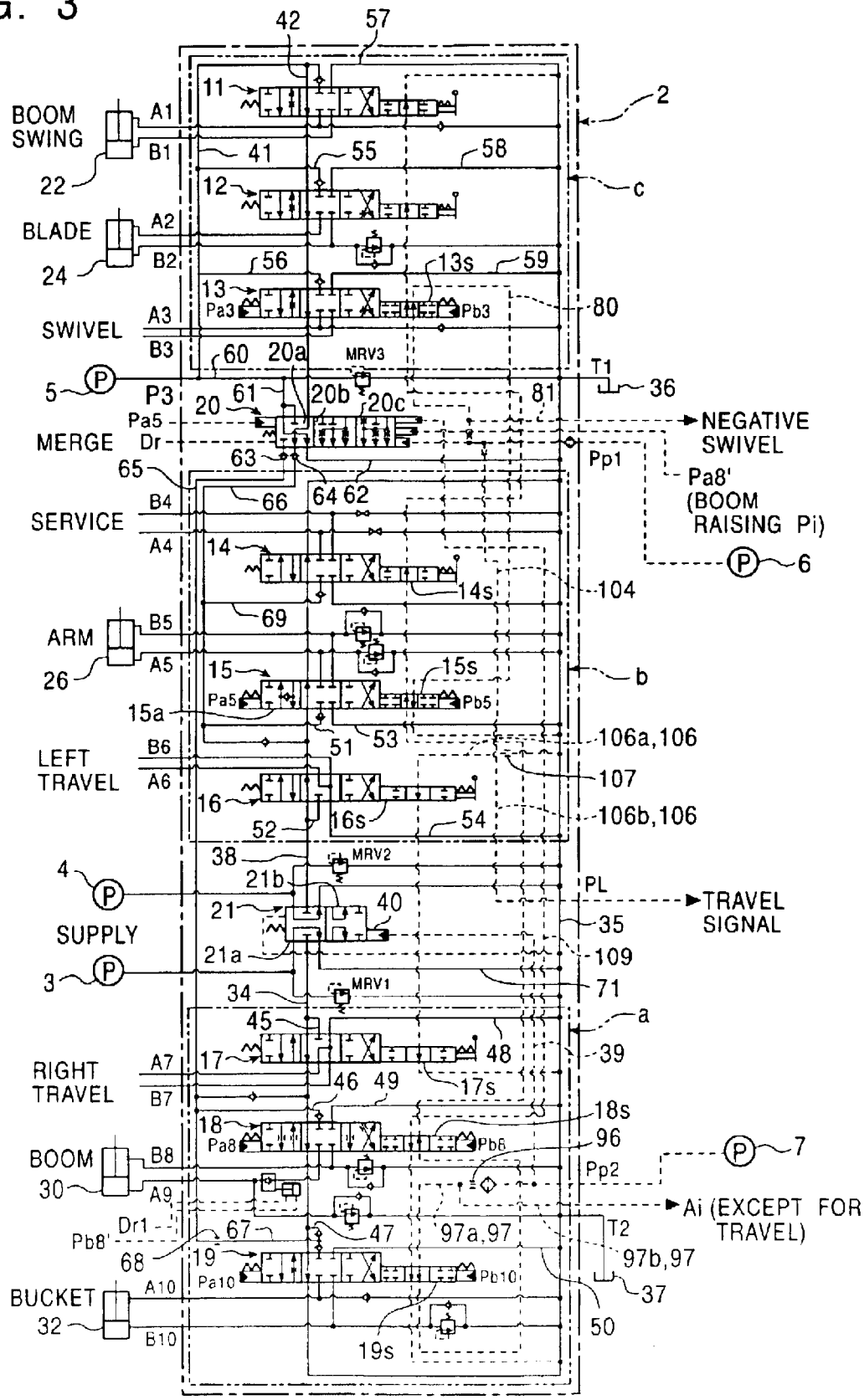
FIG. 3 is a circuit diagram of a hydraulic circuit according to a modification.
Figure 5:
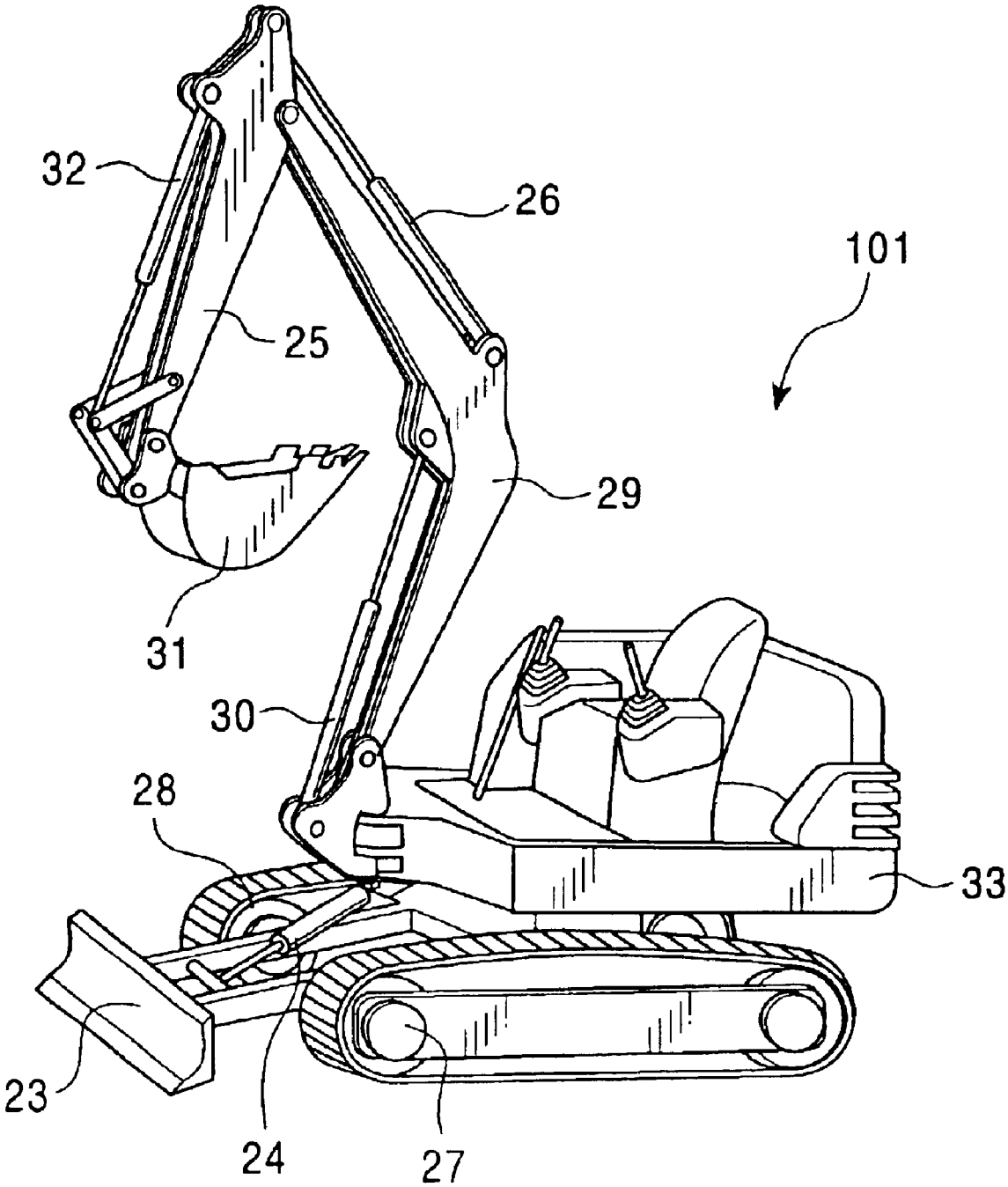
FIG. 5 is a schematic view showing a construction machine to which the hydraulic circuit according to the present invention is applicable.

A hydraulic circuit according to an embodiment of the present invention will be described below with reference to the drawings. FIGS. 1, 3 and 5 show, by way of example, the embodiment, a modification, and a construction machine in which the hydraulic circuit according to the present invention is employed, respectively.

Embodiment

A hydraulic circuit 1 according to the embodiment is used in a construction machine, e.g., a small excavator 150 provided with a plurality of hydraulic actuators as shown in FIG. 5. The hydraulic circuit 1 includes, as shown in FIG. 1, a plurality of directional control valves 11 to 19 for controlling directions of connection between respective hydraulic actuators and corresponding hydraulic pumps or tanks and flow rates of pressure oil.

Referring to FIGS. 1 and 5, the directional control valves 11 to 19 have actuator ports A1 to A7, A9 to A10, B1 to B8, and B10 connected to the respective actuators of the small excavator 150 shown in FIG. 5. Some of the actuators corresponding to the directional control valves 11 to 19 appear in FIG. 1. More specifically, the directional control valve 11 is associated with a cylinder 22 coupled to a boom swing actuator (not shown), the directional control valve 12 is associated with a cylinder 24 coupled to an earth-moving blade 23, and the directional control valve 13 is associated with a hydraulic motor (not shown) for driving a swivel body 33 (swivel actuator). The directional control valve 14 is a spare (service) one and is not used here. The directional control valve 15 is associated with an arm cylinder 26 for an arm 25, the directional control valve 16 is associated with a hydraulic motor (not shown) for driving a left travel device 27, and the directional control valve 17 is associated with a hydraulic motor (not shown) for driving a right travel device 28. The directional control valve 18 is associated with a boom cylinder 30 for a boom 29, and the directional control valve 19 is associated with a bucket cylinder 32 for a bucket 31.

With the operation of each of the directional control valves 11 to 19, the direction of line connection in which the pressure oil is supplied to and returned from the corresponding actuator is changed over so as to operate that actuator. Incidentally, the directional control valves 11, 12, 14, 16 and 17 are manually operated ones, and the directional control valves 13, 15, 18 and 19 are remotely controlled ones.

In FIG. 1, the pressure oil is supplied to the hydraulic circuit 1 from not-shown three hydraulic pumps (first to third pumps). A first pump 3 is connected to the hydraulic circuit 1 at a pump port P1, a second pump 4 is connected to it at a pump port P2, and a third pump 5 is connected to it at a pump port P3.

Further, the hydraulic circuit 1 includes three circuits (first circuit a, second circuit b, and third circuit c) for connection to the respective pumps from which the pressure oil is supplied. More specifically, the first circuit a includes the directional control valves 17, 18 and 19, which are supplied with the pressure oil from the first pump 3 through the pump port P1 and connected to a first unloading line 34. The right travel directional control valve 17 is disposed on the most upstream side of the first unloading line 34, and the other directional control valves 18, 19 than the right travel directional control valve 17 are connected to the first unloading line 34 on the side downstream of the right travel directional control valve 17. The directional control valves 17, 18 and 19 are supplied with the pressure oil from the first unloading line 34 through respective lines 45, 46 and 47, and are communicated with a tank line 35 through respective drain lines 48, 49 and 50. The most downstream side of the first unloading line 34 is also connected to the tank line 35. Additionally, the tank line 35 is connected to a tank 36 through tank ports T1 and T2.

The second circuit b includes the directional control valves 14, 15 and 16, which are supplied with the pressure oil from the second pump 4 through the pump port P2 and connected to a second unloading line 38. The left travel directional control valve 16 is disposed on the most upstream side of the second unloading line 38, and the other directional control valves 15, 14 than the left travel directional control valve 16 are connected to the second unloading line 38 on the side downstream of the left travel directional control valve 16. The directional control valves 15, 16 other then the spare (service) one 14 are supplied with the pressure oil from the second unloading line 38 through respective lines 51, 52, and are communicated with the tank line 35 through respective drain lines 53, 54. The most downstream side of the second unloading line 38 is also connected to the tank line 35 as with the first unloading line 34.

A supply control (changeover) valve 21 is connected between the first pump 3 and the second pump 4 and between the first circuit a and the second circuit b. When the supply control valve 21 is shifted from an unloading position 21*a*, in which the first and second pumps 3 and 4 are communicated with the tank line 35 through respective lines 70 and 71, to an operative position 21*b*, the pressure oil can be supplied respectively from the first pump 3 and the second pump 4 to the first circuit a and the second circuit b. The shift of the supply control valve 21 from the unloading position 21*a* to the operative position 21*b* is performed with pilot pressure oil from a pilot pump 7 acting upon a pilot pressure bearing portion 40 of the supply control valve 21 through a pilot port $P_p$2 and a pilot hydraulic line 39. Note that a pilot pressure signal will be described later.

Finally, the third circuit c includes the directional control valves 11, 12 and 13, which are supplied with the pressure oil from the third pump 5 through the pump port P3 and connected to a third unloading line 42 through a supply line 41. The directional control valves 11, 12 and 13 are connected to the third unloading line 42 in this order from the upstream side, and an end of the third unloading line 42 downstream of the swivel directional control valve 13 on the most downstream side is connected to a merging valve 20 described later. Then, the supply line 41 is connected to the directional control valves 12, 13 through respective lines 55, 56, and the directional control valves 11, 12 and 13 are communicated with the tank line 35 through respective drain lines 57, 58 and 59.

Moreover, in third circuit c, a line 60 is branched from the supply line 41 communicating with an upstream end of the third unloading line 42 and is extended to the tank line 35 through a relief valve 43. In addition, a supply line 61 communicating with the merging valve 20 is branched from midway the line 60. The supply line 61 is further branched to two lines that are both communicated with the merging valve 20.

The merging valve 20 is communicated with the third pump 5 through the supply line 61 and is also communicated with the tank line 35 through a drain line 62. Also, a first merging line 65 and a second merging line 66 are connected to the merging valve 20 through respective check valves 63, 64. The first merging line 65 is communicated with the first circuit a, and the second merging line 66 is communicated with the second circuit b.

The first merging line 65 is communicated with the directional control valves 18, 19 in the first circuit a other than the right travel directional control valve 17 through respective lines 46, 47. A throttle 68 is disposed in midway the line 67 so that the pressure oil can be supplied to the boom directional control valve 18 with priority to the bucket directional control valve 19.

The second merging line 66 is communicated with the directional control valves 14, 15 in the second circuit b other than the left travel directional control valve 16 through respective lines 51, 69. The line 51 also merges with the second unloading line 38.

A description is now made of how to communicate and disconnect the third pump 5 with and from the first merging line 65 and the second merging line 66 upon shift of the merging valve 20.

The merging valve 20 has four shift positions, i.e., an unloading position 20*a*, a first shift position 20*b*, a second shift position 20*c*, and an independent travel position 20*d*. The merging valve 20 is shifted, as described later, to the first shift position 20*b*, the second shift position 20*c*, and the independent travel position 20*d* in response to pilot pressure commands acting upon pilot pressure bearing portions 72, 73 and 74, respectively. Note that the merging valve 20 is shifted between the first shift position 20*b* and the second shift position 20*c* in a proportional/stepwise manner depending on the pressure acting upon the pilot pressure bearing portion 73.

Figure 2:
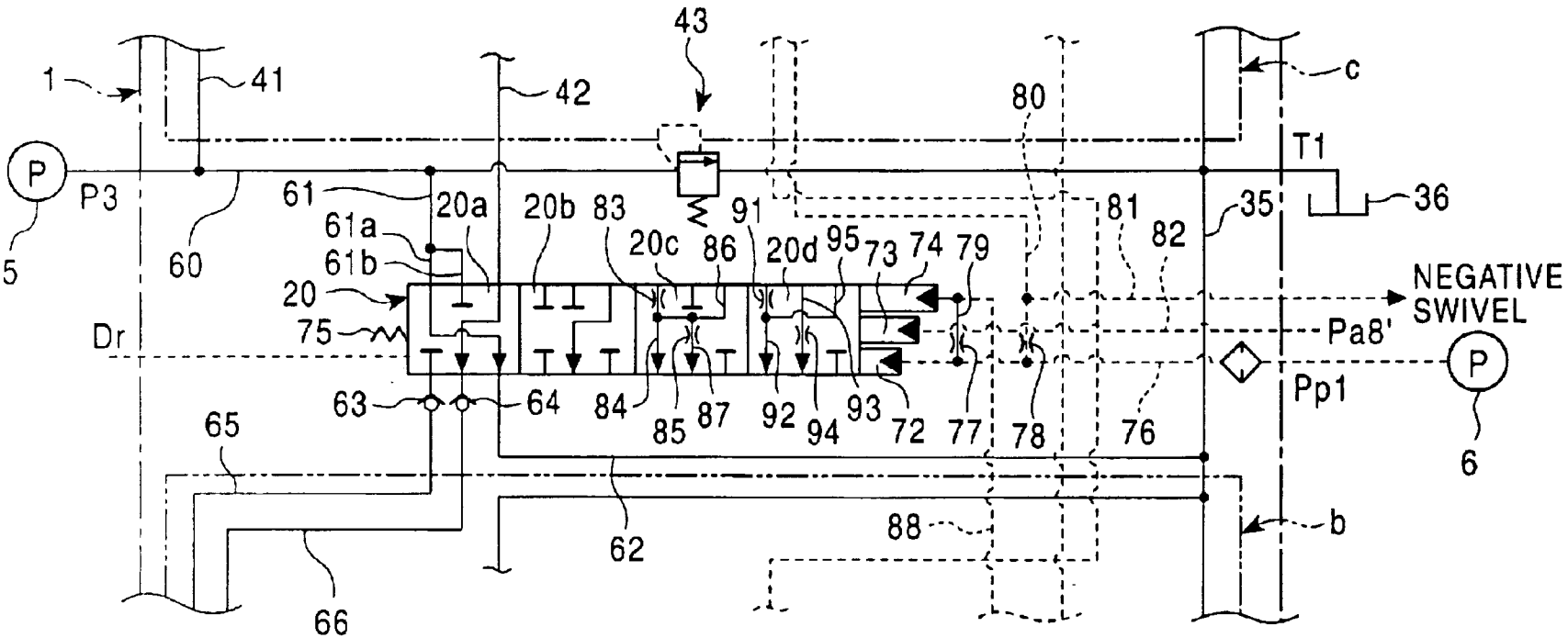
FIG. 2 is an enlarged circuit diagram of a merging valve in the hydraulic circuit according to the embodiment.

Those four shift positions will be described below one by one in order with reference to FIG. 2, which is an enlarged circuit diagram of the merging valve 20, along with FIG. 1.

First, the unloading position 20*a* is a position that is held by a spring 75 when no pilot pressure is supplied to the pilot pressure bearing portion 72 through a valve (not shown). When the merging valve 20 is in the unloading position 20*a*, one 61*a* of the supply line 61 is communicated with the tank line 35, the other supply line 61*b* is cut off, and the third unloading line 42 downstream of the swivel directional control valve 13 is communicated with the second merging line 66. Additionally, the second merging line 66 is communicated with the second unloading line 38.

Next, the first shift position 20*b* is selected upon the pilot pressure being supplied to the pilot pressure bearing portion 72. The pilot pressure oil acts upon the pilot pressure bearing portion 72 from the pilot port $P_p$1 through a pilot hydraulic line 76. Pilot hydraulic lines 79, 80 are communicated with the pilot hydraulic line 76. However, since throttles 77, 78 are disposed respectively in the pilot hydraulic lines 79, 80, the pilot pressure acts upon the pilot pressure bearing portion 72 without reduction, whereby the merging valve 20 is shifted from the unloading position 20*a* to the first shift position 20*b*.

The pilot hydraulic line 79 serves to introduce the pilot pressure oil to act upon the pilot pressure bearing portion 74 for the shift to the independent travel position 20*d*, and it is described later in detail. The pilot hydraulic line 80 is connected to sub-valves 13*s*, 15*s* of the directional control valves 13, 15 so that it selectively establishes or cuts off the communication by the operation of the sub-valves 13*s*, 15*s*. A downstream end of the pilot hydraulic line 80 is communicated with the tank line 35. Then, when at least one of the directional control valves 13 and 15 is shifted, the pilot hydraulic line 80 is cut off and the pressure oil is supplied to a hydraulic line 81 branched from the line 80, whereby a negative swivel pressure (brake release pressure) is taken out as shown (see FIG. 1).

When the merging valve 20 is in the first shift position 20*b*, the two supply lines 61*a* and 61*b*, to which the pressure oil is directly supplied from the third pump 5, are both cut off and a downstream end of the third unloading line 42 is communicated with the second merging line 66. In other words, a surplus part of the pressure oil supplied from the third pump 5 to the directional control valves 11 to 13 in the third circuit c is supplied to the directional control valves 14, 15 in the second circuit b through the second merging line 66.

The second shift position 20*c* will now be described. When the merging valve 20 is in the second shift position 20*c*, the one 61*a* of the supply line 61 is communicated with the first merging line 65 through a communicating line 84 provided with a throttle 83, and it is also communicated with the second merging line 66 through another communicating line 87 branched from the communicating line 84 and provided with a throttle 85. The other supply line 61*b* is kept cut off. Further, a downstream end of the third unloading line 42 is communicated with the communicating lines 84, 87 through the communicating line 86 so that the third unloading line 42 is communicated with the first merging line 65 through no throttle and with the second merging line 66 through the throttle 85.

Between the first shift position 20*b* and the second shift position 20*c*, the merging valve 20 is moved in a proportional/stepwise manner depending on a pressure denoted by a pilot port Pa8'. The pilot port pressure Pa8' is a pilot pressure sent to a pilot port Pa8 of the directional control valve 18 for commanding the boom raising operation by the boom cylinder 30.

With such an arrangement, when the directional control valve 18 is not operated, the merging valve 20 is held at the first shift position 20*b* and the pressure oil supplied toward the third circuit c under a pressurized state can also be introduced to the second circuit b, which requires supply of the pressure oil, without wasteful loss while preventing the pressure oil from being introduced to the first circuit a in which the directional control valves are not operated. When the directional control valve 18 is operated, the pressure oil from the third pump 5 can be supplied to both the first circuit a and the second circuit b for the merging purpose.

Further, with the merging valve 20 moved between the first shift position 20*b* and the second shift position 20*c* in a proportional/stepwise manner depending on the pilot port pressure Pa8', when the pilot pressure from a remote control valve (not shown) is elevated to increase the raising speed of the boom cylinder 30, for example, the directional control valve 18 is moved to a shift position 18*a* and correspondingly the merging valve 20 is moved to the second shift position 20*c*. Accordingly, the pressure oil sent to the second circuit b is reduced, while the pressure oil is sent to the first circuit a at a larger flow rate. Thus, the pressure oil can be distributed to the first circuit a and the second circuit b depending on the flow rate of the pressure oil required by the boom cylinder 30.

Moreover, in the second shift position 20*c* of the merging valve 20, the connection to the first circuit a and the second circuit b is established not only from the side upstream of the directional control valves 11, 12 and 13 in the third circuit c through the throttles 83 and 85, but also from the side downstream of the directional control valves 11, 12 and 13 in the third circuit C. Therefore, the pressure oil sent from the third pump 5 under a pressurized state can be supplied to both the first circuit a and the second circuit b while supplying the pressure oil from the third pump 5 to the third circuit c. In addition, surplus pressure oil drained from the side downstream of the directional control valves 11, 12 and 13 in the third circuit c can also be supplied to both the first circuit a and the second circuit b under the pressurized state. As a result, the pressure oil from the third pump 5 can be efficiently distributed to the first circuit a and the second circuit b as well without wasteful loss, and the operability of the actuators 25, 29 and 31 associated with the first circuit a or the second circuit b can also be improved.

While the shift amount of the merging valve 20 between the first shift position 20*b* and the second shift position 20*c* is determined depending on the pilot pressure applied through the pilot port Pa8 in the above-described embodiment, that shift amount may be determined depending on the pilot pressure applied through a pilot port Pa5 for the arm directional control valve 15, or may be determined on condition that at least one or all of the boom directional control valve 18, the bucket directional control valve 19, etc. are operated. Alternatively, the shift amount of the merging valve 20 may be determined depending on the load pressures of the boom cylinder 30 and the arm cylinder 26, or on a result of comparison between those load pressures.

Finally, a description is made of the independent travel position 20*d*. When the merging valve 20 is in the independent travel position 20*d*, the one 61*a* of the supply line 61 is connected to the first merging line 65 through a first throttle 91, and the other supply line 61*b* is connected to the second merging line 66 through a second throttle 94 and a communicating line 93. Further, the downstream end of the third unloading line 42 is connected to the first merging line 65 through another communicating line 95 in communication with the communicating line 92.

The shift to the independent travel position 20*d* is performed upon the pilot pressure being supplied to the pilot pressure bearing portion 74. More specifically, the pressure oil sent from a pilot pump 6 through the pilot hydraulic line 76 is also partly sent to the pilot hydraulic line 79 through the throttle 77. The pilot hydraulic line 79 is connected to the pilot pressure bearing portion 74 and is branched to a hydraulic line 88. The hydraulic line 88 is connected to sub-valves (auxiliary valves) 16*s*, 17*s*, 18*s* and 19*s* disposed respectively in association with the directional control valves 16, 17, 18 and 19 in this order so as to be operated at the same time as the directional control valves, and a downstream end of the hydraulic line 88 is connected to the tank line 35.

When the directional control valves 18 and 19 are operated, the sub-valves 18*s* and 19*s* bring the hydraulic line 88 from a communicated state to a cutoff state. Also, when the directional control valves 16 and 17 are operated, the sub-valves 16*s* and 17*s* cut off respective hydraulic lines 89 and 90 while the hydraulic line 88 is kept in the communicated state.

With such an arrangement of the hydraulic lines 79, 88, 89 and 90, when both of the right travel directional control valve 17 and the left travel directional control valve 16 and at least one of the other directional control valves 18, 19 in the first circuit a than the right travel directional control valve 17 are operated, the pilot pressure oil sent from the pilot pump 6 acts upon the pilot pressure bearing portion 74, whereupon the merging valve 20 is shifted to the independent travel position 20*d*.

Thus, because of the independent travel position 20*d* providing the above-described circuit arrangement, when the travel directional control valves 16, 17 and at least one of the other directional control valves 18, 19 than the travel directional control valves are operated at the same time, the pressure oil sent from the third pump 5 under a pressurized state can be surely supplied to at least one of the other directional control valves 18, 19.

Moreover, in the independent travel position 20*d* of the merging valve 20, the connection to the first circuit a is established not only from the side upstream of the directional control valves 11, 12 and 13 in the third circuit c through the throttle 91, but also from the side downstream of the directional control valves 11, 12 and 13 in the third circuit c through the line 95. Therefore, the pressure oil sent from the third pump 5 can be supplied to the first circuit a while supplying the pressure oil from the third pump 5 to the third circuit c. In addition, surplus pressure oil drained from the side downstream of the directional control valves 11, 12 and 13 in the third circuit c can also be supplied to the first circuit a under the pressurized state. As a result, the pressure oil from the third pump 5 can be efficiently distributed to the first circuit a and the second circuit b as well without wasteful loss, and the operability of the actuators 25, 29 and 31 associated with the first circuit a or the second circuit b can also be improved.

An arrangement provided in the hydraulic circuit 1 for taking out a travel signal and an auto-idle signal will be described below.

A construction machine, such as a crawler vehicle, provided with a travel device and a plurality of actuators has the auto-idle function for controlling the rotational speed of a driving source depending on the state of operation of the construction machine.

For that control, the construction machine includes a circuit for taking out the auto-idle signal to detect the state of operation of each actuator and to carry out the auto-idle function.

Also, the construction machine is often provided with a safety device, such as a light or a siren, for informing people around itself of the fact that the construction machine is traveling.

In such a case, a hydraulic circuit for use in the construction machine also includes a circuit for taking out the travel signal to detect the state of operation of the travel device and to operate the safety device.

To realize the circuit for taking out the travel signal, it is conceivable to provide an additional pilot valve in the directional control valve for the travel device. This solution, however, would increase the size of the travel directional control valve correspondingly.

The hydraulic circuit 1 according to the embodiment is intended to, as described later, avoid an increase in size of a hydraulic circuit for use in a construction machine provided with a safety device and the auto-idle function.

More specifically, the hydraulic circuit 1 is used in a construction machine provided with a safety device for informing the surroundings of the fact that the construction machine is traveling, and the auto-idle function for controlling the rotational speed of a driving source depending on the state of operation of each actuator. Then, the hydraulic circuit 1 comprises a travel directional control valve for controlling a direction of connection between a hydraulic pump or tank and a travel device and a flow rate of pressure oil therebetween, another directional control valve for controlling a direction of connection between the pump or tank and another actuator other than the travel device and a flow rate of pressure oil therebetween, a travel signal hydraulic line for generating a travel signal when the travel directional control valve is operated, and an auto-idle signal hydraulic line for generating an auto-idle signal when the another directional control valve is operated, wherein the rotational speed of the driving source is controlled in accordance with states of the travel signal hydraulic line and the auto-idle signal hydraulic line.

Referring to FIG. 1, the pilot pressure oil supplied from the pilot pump 7 through the pilot port $P_p$2 acts upon the pilot pressure bearing portion 40 of the pilot-operated supply control valve 21 through the pilot hydraulic line 39, and it is also supplied to an auto-idle signal hydraulic line 97 through a throttle 96. Further, a travel signal hydraulic line 99 is communicated with the pilot hydraulic line 39 through a throttle 98.

The travel signal hydraulic line 99 comprises a control-valve communicating hydraulic line 99*a* and a travel signal taking-out hydraulic line 99*b* branched from the control-valve communicating hydraulic line 99*a*. The control-valve communicating hydraulic line 99*a* is connected to the sub-valves 16*s*, 17*s* of the travel directional control valves 16, 17 and then connected to the hydraulic line 90 for communication with the tank line 35. The travel signal taking-out hydraulic line 99*b* is communicated with a travel signal taking-out port PL.

With such connection between the pilot pump 7 and the hydraulic lines 35, 39, 40, 90, 98 and 99, etc., the construction machine (small excavator 150) provided with the hydraulic circuit 1 is able to take out the travel signal for lighting up the safety device for informing the surroundings of the fact that the construction machine is traveling. More specifically, when the travel directional control valves 16, 17 are not operated, the pilot pressure oil introduced to the travel signal hydraulic line 99 flows to the tank line 35 through the control-valve communicating hydraulic line 99*a* and the hydraulic line 90. When at least one of the travel directional control valves 16, 17 is operated from the above condition, the small excavator 150 start to travel, and at the same time the control-valve communicating hydraulic line 99*a* is cut off, whereupon a pressure generates in the travel signal taking-out hydraulic line 99*b* and the travel signal generates at the travel signal taking-out port PL. The generated travel signal is caused to act upon a pressure switch or the like for operating the safety device (not shown). Responsively, the safety device is operated to inform the surroundings of the fact that the small excavator 150 is traveling.

Also, the auto-idle signal hydraulic line 97 comprises a control-valve communicating hydraulic line 97*a* and an auto-idle signal taking-out hydraulic line 97*b* branched from the control-valve communicating hydraulic line 97*a*. The control-valve communicating hydraulic line 97*a* is connected to the sub-valves 19*s*, 18*s*, 15*s*, 14*s*, 13*s*, 12*s* and 11*s* of the other directional control valves 19, 18, 15, 14, 13, 12 and 11 than the travel directional control valves 16, 17 in that order and then communicated with the tank line 35. The auto-idle signal taking-out hydraulic line 97*b* is communicated with an auto-idle signal taking-out port Ai.

When any of the directional control valves 11, 12, 13, 14, 15, 18 and 19 is not operated, the pressure oil sent from the pilot pump 7 and partly introduced to the auto-idle signal hydraulic line 97 through a throttle flows to the tank line 35 through the control-valve communicating hydraulic line 97*a*. When at least one of the directional control valves 11, 12, 13, 14, 15, 18 and 19 is operated from the above condition, the control-valve communicating hydraulic line 97*a* is cut off, whereupon a pressure generates in the auto-idle signal taking-out hydraulic line 97*b* and the auto-idle signal generates at the auto-idle signal taking-out port Ai.

Using the travel signal and the auto-idle signal thus taken out, the rotational speed of the driving source is controlled such that when the travel signal and the auto-idle signal are both not generated, the rotational speed of the driving source is reduced to a predetermined value, and when any of the travel signal and the auto-idle signal is generated, the rotational speed of the driving source is increased to a predetermined value.

Thus, as described above, the signal generating hydraulic line for the auto-idle function is separated into one for the travel directional control valves 16, 17 and the other for the other directional control valves 11, 12, 13, 14, 15, 18 and 19, and the travel signal hydraulic line 99 is used for both the safety device and the auto-idle function. Accordingly, there is no need of providing a pilot line and a sub-valve dedicated only for the safety device, and an increase in size of the travel directional control valves 16, 17 can be avoided.

Modification

A hydraulic circuit 2 according to a modification will be described below.

The hydraulic circuit 2 has substantially the same circuit configuration as that of the hydraulic circuit 1. In FIG. 3, corresponding elements are denoted by the same symbols as those in FIG. 1. The hydraulic circuit 2 differs from the hydraulic circuit 1 in the following three points. First, the merging valve 20 has only three shift positions, i.e., an unloading position 20*a*, a first shift position 20*b*, and a second shift position 20*c*. In the merging valve 20 of the hydraulic circuit 2, the second shift position 20*c* serves also as an independent travel position. Secondly, the hydraulic lines communicating with the pilot pumps 6 and 7 have a different configuration. Thirdly, the parallel line 51 branched from the second merging line 66 and connected to the arm directional control valve 15 is connected to only the arm directional control valve 15 without communicating with the second unloading line 38. Of those three different points, the first and second points will be described below in more detail.

Figure 4:
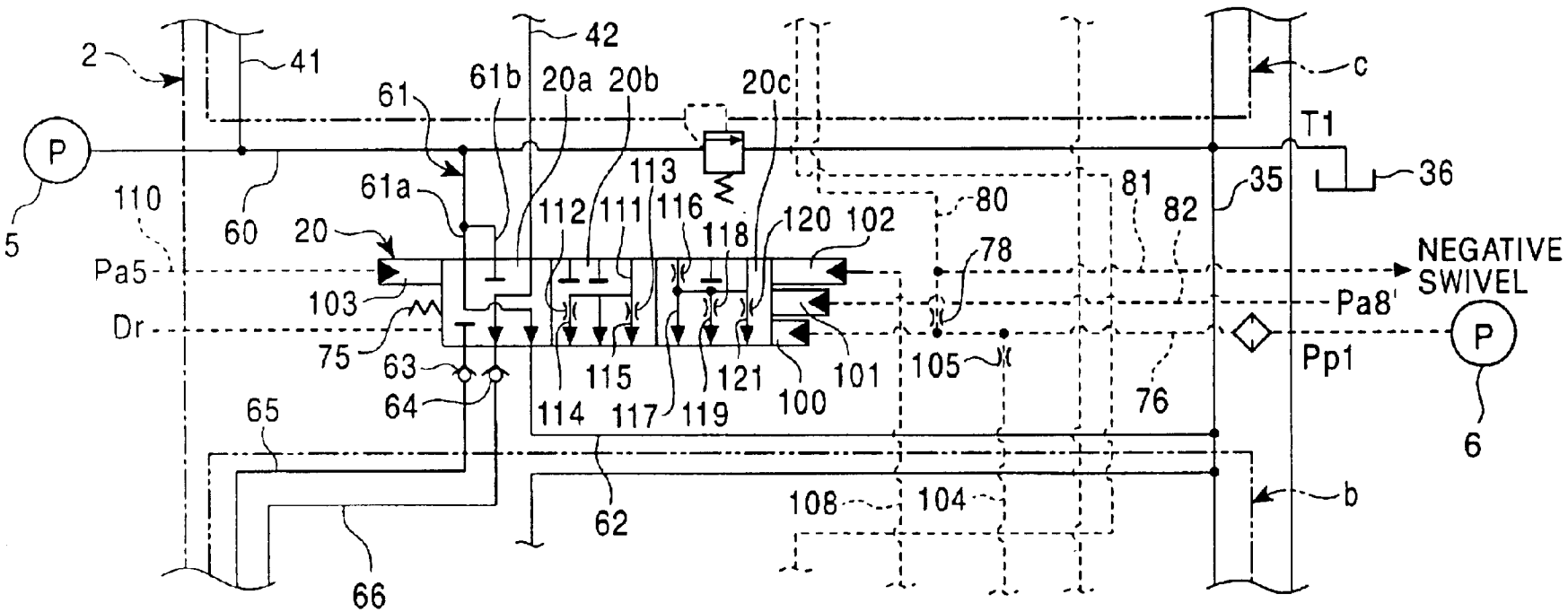
FIG. 4 is an enlarged circuit diagram of a merging valve in the hydraulic circuit according to the modification.

The first different point is described with reference to FIG. 4, which is an enlarged circuit diagram of the merging valve 20 in the hydraulic circuit 2, along with FIG. 3. As with the case of the hydraulic circuit 1, the merging valve 20 selectively communicates or cuts off the third pump with or from the first merging line 65 the second merging line 66. Also, the merging valve 20 has, as mentioned above, the three shift positions, i.e., the unloading position 20*a*, the first shift position 20*b*, and the second shift position 20*c*. The merging valve 20 is shifted to the first shift position 20*b*, the second shift position 20*c*, the second shift position (independent travel position) 20*c*, and the first shift position 20*b* in response to pilot pressure commands acting upon pilot pressure bearing portions 100, 101, 102 and 103, respectively, as described later. Note that the merging valve 20 is shifted between the first shift position 20*b* and the second shift position 20*c* in a proportional/stepwise manner depending on the pressures acting upon the pilot pressure bearing portions 101, 103.

The unloading position 20*a* is the same as that in the hydraulic circuit 1.

When the merging valve 20 is in the first shift position 20*b*, the two supply lines 61*a* and 61*b*, to which the pressure oil is directly supplied from the third pump 5, are both cut off and the downstream end of the third unloading line 42 is communicated with the second merging line 66 through a communicating line 111. The communicating line 111 is further branched to communicating lines 114, 115 through respective throttles 112, 113. The communicating lines 114, 115 are communicated with the first merging line 65 and the drain line 62, respectively. The merging valve 20 is shifted to the first shift position 20*b* with the pilot pressure acting upon the pilot pressure bearing portion 100. Hydraulic lines 104, 80 are communicated with the pilot hydraulic line 76 connecting the pilot port Pp1 and the pilot pressure bearing portion 100. However, since throttles 105, 78 are disposed respectively in the hydraulic lines 104, 80, the pilot pressure acts upon the pilot pressure bearing portion 100 without reduction, whereby the merging valve 20 is shifted from the unloading position 20*a* to the first shift position 20*b*.

With such a circuit connection, in the first shift position 20*b*, the pressure oil can be supplied from the third pump 5 to the second circuit b at a larger flow rate than that to the first circuit a. Also, since surplus pressure oil is drained to the tank through the throttle 113, the third pump is prevented from being subjected to overload.

Next, when the merging valve 20 is in the second shift position 20*c*, the one 61*a* of the supply line 61 is communicated with the first merging line 65 through a communicating line 117 provided with a throttle 116, while the other supply line 61*b* is kept cut off. Also, the downstream end of the third unloading line 42 is communicated with the communicating line 117 so that it is communicated with the first merging line 65 directly and with the second merging line 66 and the drain hydraulic line 62 through communicating lines 119, 121 provided with throttles 118, 120, respectively. Note that the throttle 120 has a smaller opening degree than the throttle 118.

Between the first shift position 20*b* and the second shift position 20*c*, the merging valve 20 is shifted in a proportional/stepwise manner depending on a balance between pressures at the pilot ports Pa5 and Pa8'. More specifically, as the pressure at the pilot port pa8' rises, the merging valve 20 is moved toward the second shift position 20*c* to increase the flow rate of the pressure oil sent to the first circuit a. On the contrary, as the pressure at the pilot port pa5 rises, the merging valve 20 is moved toward the first shift position 20*b* to increase the flow rate of the pressure oil sent to the second circuit b. While the pressures at the pilot ports Pa5, Pa8' are introduced to the merging valve 20 in this modification, load pressures of the boom cylinder 30 and the arm cylinder 26 may be introduced instead.

The second shift position 20*c* serves also as the independent travel position. In other words, the independent travel position 20*d* in the hydraulic circuit 1 is omitted for simplification of the circuit by providing the throttle 118 such that the pressure oil is distributed to the first circuit a and the second circuit b in the second shift position 20*c* similarly to the case that the merging valve 20 is in the independent travel position 20*d* in the hydraulic circuit 1. The shift to the second shift position 20*c* is performed upon the pilot pressure oil sent from the pilot pump 6 acting upon the pilot pressure bearing portion 102 when both of the right travel directional control valve 17 and the left travel directional control valve 16 and at least one of the other directional control valves 18, 19 in the first circuit a than the right travel directional control valve 17 are operated.

The pressure oil sent from the pilot pump 6 through the pilot hydraulic line 76 is also partly sent to the pilot hydraulic line 104 through the throttle 105. The hydraulic line 104 is communicated with a travel signal hydraulic line 106 and is also communicated with a pilot hydraulic line 108 that is connected to the pilot pressure bearing portion 102 through a throttle 107.

The travel signal hydraulic line 106 is branched to a control-valve communicating hydraulic line 106*a* connected to the sub-valves 16*s*, 17*s* of the left and right directional control valves 16, 17 for communication with the tank line 35, and a travel signal taking-out hydraulic line 106*b* connected to the travel signal taking-out port PL.

Also, a hydraulic line 109 is branched from the pilot hydraulic line 108 at a position downstream of the throttle 107, and the hydraulic line 109 is connected to the sub-valves 18*s* of the boom directional control valve 18 and the sub-valves 19*s* of the bucket directional control valve 19 in the first circuit a for communication with the tank line 35.

With such a configuration of the hydraulic lines 104, 105, 106, 107, 108 and 109, etc., when any of the left and right travel directional control valves 16, 17 is not operated, the pilot pressure oil introduced to the hydraulic line 104 flows to the tank line 35 through the control-valve communicating hydraulic line 106*a*. Then, when at least one of the left and right travel directional control valves is operated, the control-valve communicating hydraulic line 106*a* is cut off and the travel signal generates in the travel signal taking-out hydraulic line 106*b*. When any one of the boom directional control valve 18 and the bucket directional control valve 19 is operated from the above condition, the hydraulic line 109 is cut off, whereupon the pressure oil flows into the pilot hydraulic line 108 to act upon the pilot pressure bearing portion 102. Consequently, the merging valve 20 is shifted to the independent travel position (second shift position) 20*c*.

As a result, even when the travel directional control valves 16, 17 and at least one of the other directional control valves 18, 19 than the travel directional control valves are operated at the same time, the pressure oil can be supplied from the third pump 5 under the pressurized state to the other directional control valves 18, 19 with reliability.

Furthermore, the hydraulic circuit 2 differs from the hydraulic circuit 1 in configuration of pilot lines for taking out the travel signal and shifting to the independent travel position (second shift position) 20*c*. More specifically, the travel signal hydraulic line 106 and the pilot hydraulic line 108 are branched from the hydraulic line 104 communicating with the pilot pump 6. Then, the travel signal is taken out from the same pressure oil as used to generate the signal for shifting to the independent travel position (second shift position) 20*c*, and is employed for the safety device. Accordingly, there is no need of providing a pilot line and a sub-valve dedicated only for the safety device, and an increase in size of the travel directional control valves 16, 17 can be avoided.

What is claimed is:

1. A hydraulic circuit for driving actuators by pressure oil supplied from a first pump, a second pump and a third pump and returned to a tank, the hydraulic circuit comprising:

a first circuit including a directional control valve supplied with the pressure oil from said first pump, the directional control valve in said first circuit controlling connection between said first pump or said tank and at least one of said actuators and a flow rate of the pressure oil therebetween;

a second circuit including a directional control valve supplied with the pressure oil from said second pump, the directional control valve in said second circuit controlling connection between said second pump or said tank and at least one of said actuators and a flow rate of the pressure oil therebetween;

a third circuit including a directional control valve supplied with the pressure oil from said third pump, the directional control valve in said third circuit controlling connection between said third pump or said tank and at least one of said actuators and a flow rate of the pressure oil therebetween;

a first merging line disposed to be capable of supplying the pressure oil sent from said third pump under a pressurized state to the directional control valve in said first circuit;

a second merging line disposed to be capable of supplying the pressure oil sent from said third pump under a pressurized state to the directional control valve in said second circuit; and a merging valve for selectively communicating or cutting off said first merging line and said second merging line with or from said third pump, said merging valve having a first shift position at which said third pump is connected to said second merging line, and a second shift position at which said third pump is connected to said first merging line and said second merging line, said merging valve being continuously shifted between said first shift position and the second shift position depending on a state of said first circuit or said second circuit.

2. The hydraulic circuit according to claim 1, wherein when the directional control valve in said first circuit is not operated, said merging valve is shifted to said first shift position, and when the directional control valve in said first circuit is operated, said merging valve is shifted toward said second shift position depending on a state of operation of the directional control valve in said first circuit.

3. The hydraulic circuit according to claim 1, wherein said merging valve is continuously shifted between said first shift position and said second shift position depending on a flow rate of the pressure oil required by the directional control valve in said first circuit or said second circuit so that the pressure oil from said third pump is distributed and sent to said first circuit or said second circuit under a pressurized state.

4. A hydraulic circuit for driving actuators by pressure oil supplied from one pump and the other pump and returned to a tank, the hydraulic circuit comprising:

one circuit including a directional control valve supplied with the pressure oil from said one pump, the directional control valve in said one circuit controlling connection between said one pump or said tank and at least one of said actuators and a flow rate of the pressure oil therebetween;

the other circuit including a directional control valve supplied with the pressure oil from said other pump, the directional control valve in said other circuit controlling connection between said other pump or said tank and at least one of said actuators and a flow rate of the pressure oil therebetween;

a merging line disposed to be capable of supplying the pressure oil sent from said other pump under a pressurized state to the directional control valve in said one circuit; and a merging valve for selectively communicating or cutting off said merging line with or from said other pump, said merging valve being capable of sending the pressure oil from said other pump under a pressurized state to said one circuit and reducing an opening degree of a throttle disposed between said other pump and said tank depending on a flow rate of the pressure oil required by the directional control valve in said one circuit, thereby increasing a flow rate of the pressure oil sent to said one circuit under the pressurized state.

5. A hydraulic circuit for driving actuators by pressure oil supplied from a first pump, a second pump and a third pump and returned to a tank, the hydraulic circuit comprising:

a first circuit including a directional control valve supplied with the pressure oil from said first pump, the directional control valve in said first circuit controlling connection between said first pump or said tank and at least one of said actuators and a flow rate of the pressure oil therebetween;

a second circuit including a directional control valve supplied with-the pressure oil from said second pump, the directional control valve in said second circuit controlling connection between said second pump or said tank and at least one of said actuators and a flow rate of the pressure oil therebetween;

a third circuit including a directional control valve supplied with the pressure oil from said third pump, the directional control valve in said third circuit controlling connection between said third pump or said tank and at least one of said actuators and a flow rate of the pressure oil therebetween;

a first merging line disposed to be capable of supplying the pressure oil sent from said third pump under a pressurized state to the directional control valve in said first circuit;

a second merging line disposed to be capable of supplying the pressure oil sent from said third pump under a pressurized state to the directional control valve in said second circuit; and a merging valve for selectively communicating or cutting off said first merging line and said second merging line with or from said third pump, said merging valve being capable of sending the pressure oil from said third pump under a pressurized state to said first circuit and said second circuit and reducing an opening degree of a throttle disposed between said third pump and said tank depending on flow rates of the pressure oil required by the directional control valves in said first circuit and said second circuit, thereby increasing flow rates of the pressure oil sent to said first circuit and said second circuit under the pressurized state.

6. A hydraulic circuit for driving actuators by pressure oil supplied from one pump and the other pump and returned to a tank, the hydraulic circuit comprising:

one circuit including a directional control valve supplied with the pressure oil from said one pump, the directional control valve in said one circuit controlling connection between said one pump or said tank and at least one of said actuators and a flow rate of the pressure oil therebetween;

the other circuit including a directional control valve supplied with the pressure oil from said other pump, the directional control valve in said other circuit controlling connection between said other pump or said tank and at least one of said actuators and a flow rate of the pressure oil therebetween;

a merging line disposed to be capable of supplying the pressure oil sent from said other pump under a pressurized state to the directional control valve in said one circuit; and a merging valve for selectively communicating or cutting off said merging line with or from said other pump, said merging valve having a shift position at which the side upstream of the directional control valve in said other circuit is connected to said one circuit through a throttle and the side downstream of the directional control valve in said other circuit is also connected to said one circuit.

7. A hydraulic circuit for driving actuators by pressure oil supplied from a first pump, a second pump and a third pump and returned to a tank, the hydraulic circuit comprising:

a first circuit including a directional control valve supplied with the pressure oil from said first pump, the directional control valve in said first circuit controlling connection between said first pump or said tank and at least one of said actuators and a flow rate of the pressure oil therebetween;

a second circuit including a directional control valve supplied with the pressure oil from said second pump, the directional control valve in said second circuit controlling connection between said second pump or said tank and at least one of said actuators and a flow rate of the pressure oil therebetween;

a third circuit including a directional control valve supplied with the pressure oil from said third pump, the directional control valve in said third circuit controlling connection between said third pump or said tank and at least one of said actuators and a flow rate of the pressure oil therebetween;

a first merging line disposed to be capable of supplying the pressure oil sent from said third pump under a pressurized state to the directional control valve in said first circuit;

a second merging line disposed to be capable of supplying the pressure oil sent from said third pump under a pressurized state to the directional control valve in said second circuit; and a merging valve for selectively communicating or cutting off said first merging line and said second merging line with or from said third pump, said merging valve having a shift position at which the side upstream of the directional control valve in said third circuit is connected to said first circuit and said second circuit through a throttle and the side downstream of the directional control valve in said third circuit is also connected to said first circuit and said second circuit.

8. A hydraulic circuit for driving actuators by pressure oil supplied from a first pump, a second pump and a third pump and returned to a tank, the hydraulic circuit comprising:

a first circuit including a directional control valve supplied with the pressure oil from said first pump, the directional control valve in said first circuit controlling connection between said first pump or said tank and at least one of said actuators and a flow rate of the pressure oil therebetween;

a second circuit including a directional control valve supplied with the pressure oil from said second pump, the directional control valve in said second circuit controlling connection between said second pump or said tank and at least one of said actuators and a flow rate of the pressure oil therebetween;

a third circuit including a directional control valve supplied with the pressure oil from said third pump, the directional control valve in said third circuit controlling connection between said third pump or said tank and at least one of said actuators and a flow rate of the pressure oil therebetween;

a first merging line disposed to be capable of supplying the pressure oil sent from said third pump under a pressurized state to the directional control valve in said first circuit;

a second merging line disposed to be capable of supplying the pressure oil sent from said third pump under a pressurized state to the directional control valve in said second circuit; and a merging valve for selectively communicating or cutting off said first merging line and said second merging line with or from said third pump, said merging valve having a shift position at which said third pump is connected to said first merging line and said second merging line, said shift position establishing a state that the side upstream of the directional control valve in said third circuit is connected to said first circuit through a first throttle, the side upstream of the directional control valve in said third circuit is connected to said second circuit through a second throttle, and the side downstream of the directional control valve in said third circuit is connected to said first circuit.

9. The hydraulic circuit according to claim 8, further comprising sub-valves operating in interlock with the directional control valves in said first circuit and said second circuit, said sub-valves generating a pilot pressure for shifting said merging valve to said shift position.

10. The hydraulic circuit according to claim 9, further comprising detecting means disposed in a line for said pilot pressure, said detecting means detecting a state of operation of the corresponding actuator.

11. A hydraulic circuit for use in a traveling construction machine including actuators driven by pressure oil supplied from a hydraulic pump under a pressurized state and returned to a tank, and provided with a safety device for informing surroundings of the fact the construction machine is traveling, the hydraulic circuit comprising:

a travel control valve for controlling connection between said hydraulic pump or said tank and a travel actuator of said actuators and a flow rate of the pressure oil therebetween according to operation;

an auxiliary travel control valve adapted to operate at the same time as said travel control valve; and a travel signal hydraulic line for generating a travel signal upon operation of said auxiliary travel control valve, said safety device being operated in accordance with a state of said travel signal hydraulic line.

12. A hydraulic circuit for use in a construction machine having an auto-idle function of controlling a rotational speed of a driving source for a hydraulic pump depending on a state of operation of each of actuators driven by pressure oil supplied from said hydraulic pump under a pressurized state and returned to a tank, the hydraulic circuit comprising:

a travel control valve for controlling connection between said hydraulic pump or said tank and a travel actuator of said actuators and a flow rate of the pressure oil therebetween;

another control valve for controlling connection between said hydraulic pump or said tank and other one of said actuators than said travel actuator and a flow rate of the pressure oil therebetween;

a travel signal hydraulic line for generating a travel signal upon operation of said travel control valve; and an auto-idle signal hydraulic line for generating an auto-idle signal upon operation of said other control valve, the rotational speed of said driving source being controlled in accordance with a state of said travel signal hydraulic line and a state of said auto-idle signal hydraulic line.

13. The hydraulic circuit for use in a traveling construction machine according to claim 11, wherein said safety device is operated responsive to a traveling operation in both forward and reverse directions.

* * * * *